US005862828A

United States Patent [19]

Dörfler

[11] Patent Number: 5,862,828

[45] Date of Patent: Jan. 26, 1999

[54] OSCILLATING VALVE FOR A DOUBLE ACTING OPERATING CYLINDER

[75] Inventor: Erich N. Dörfler, Fuchstal, Germany

[73] Assignee: Hygrama AG, Rotkreuz, Switzerland

[21] Appl. No.: 890,037

[22] Filed: Jul. 9, 1997

[30] Foreign Application Priority Data

Jul. 10, 1996 [AT] Austria ..... 1220/96

[51] Int. Cl.[6] ..... F15B 13/42

[52] U.S. Cl. ..... 137/106; 91/306; 91/308; 91/330

[58] Field of Search ..... 91/306, 308, 330; 137/106

[56] References Cited

U.S. PATENT DOCUMENTS 3,270,776 9/1966 Carls ..... 137/270 X
3,296,941 1/1967 Rochte ..... 91/306 X
3,385,166 5/1968 Kroffke ..... 91/308 X
3,811,795 5/1974 Olsen ..... 91/306 X

*Primary Examiner*—Gerald A. Michalsky
*Attorney, Agent, or Firm*—Watson Cole Grindle Watson, P.L.L.C.

[57] ABSTRACT

For the oscillating triggering of a double acting operating cylinder (4), a reversing valve (6) has been provided and has been inserted between the pressure supply connector (5) and the two operating cylinder drive connectors (2,3) that is driven via two NOT elements (7,8), that each have been assigned to an operating position and connected with a drive connector (2,3). The reversing valve (6) is caused by pressure to periodically switch between the two operating positions. In order to stop oscillating with a defined final position of the operating cylinder (4) or start it up again, at least one of the NOT elements (7) has been provided with a pressure supply connector that can be triggered independently from the supply connector (5).

3 Claims, 1 Drawing Sheet

OSCILLATING VALVE FOR A DOUBLE ACTING OPERATING CYLINDER

BACKGROUND OF THE INVENTION

1. Field of the Invention

The invention is directed to an oscillating valve for a double acting operating cylinder with a reversing valve that is inserted between a pressure supply connector and two operating cylinder drive connectors and which is triggered via two logical NOT elements, wherein each element coordinates to an operating position and connects with one drive connector via a pressure conduit, the reversing valve periodically switching between the two operating positions.

2. The Prior Art

Such valves or valve units are known in many different applications where an operating cylinder, especially a pneumatic operating cylinder for example, extend and retract frequently. Such units are used in bulk facilities or similar arrangements, for example, where masses connected to operating cylinders constantly knock on chutes, lines, and such, in order to improve or ensure the flow of the material. The above-mentioned so-called oscillating valves assume the control of the operating cylinder's movements. Other applications in which similar oscillating movements occur include but are not limited to stirrers, or pumps.

Oscillating valves of the above-mentioned kind usually have 5/2 directional valves in slide valve designs in which the valve pistons are shifted under pressure inside the valve box by operating pistons. The reversal of the direction is obtained by two logical NOT elements where the negated connections are connected to the outlets on the side of the operating cylinder of the 5/2 directional valve. The supply for the operating pressure is on both sides directly via the same connector. In the case of pneumatic applications, the air drain connectors are equipped with exhaust air throttles.

During the oscillation the change of direction occurs by scanning the fluid pressure of the connectors on the sides of the operating cylinders of the valve. Since the exhaust air is choked with each working stroke of the pneumatic operating cylinder, stagnating pressure builds up at each respective connection. It remains until the piston of the operating cylinder comes to a halt. Since the exhaust air throttle and thus also the negated connector of the logic element has nearly ambient pressure, it pressurizes the operating piston of the respective side with pressure medium because of the negation. The valve slide therefore moves to the opposite side and thus initiates another oscillating cycle.

The start-up of the known arrangements of the above-mentioned kind is particularly disadvantageous. During each start-up, the operating cylinder extends and retracts uncontrollably, and the complete piston stroke is not yet reached. In this phase, the oscillating frequency also deviates substantially from that of the running operation. It is not until several strokes later that the state corresponding with continuous operation is reached. This is because the triggering of the oscillating valve has a stop valve connected in series which starts oscillating by applying pressure to the 5/2 directional valve and then stops it by interrupting the fluid stream. During non-operation the drive connectors leading to the operating cylinder usually contain no pressure and this causes both logic elements to be open at the beginning. Both operating pistons of the reversing valve thus have pressure applied to them when oscillation begins. Only because of a different area distribution of the reversing valve's operating element, the reversing valve moves to the side with the smaller area. Thus, the respective exit and the assigned logic element are pressurized simultaneously. The logic element now immediately interrupts the pressure supply of the respective operating valve. No stagnating pressure is present yet at the other exit because of the inertia of the system (power piston, wake space), which causes the operating piston of the reversing valve on this side to remain pressurized and thus move the valve piston of the reversing valve in the respective direction. The interaction causes the described uncontrolled movement of the valve piston and thus also of the operating cylinder during start-up. Only the slowly rising pressure level at the drive connectors on the side of the operating cylinder brings about controlled oscillation. In large operating cylinders and high oscillating frequencies, a controlled, periodic movement may not be reached at all. This disturbs many operations and severely limits the range of applications of such oscillating valves.

In addition to the start-up, the turn-off of known oscillating valves has proven to be problematic in some applications as well. When turning off a running oscillation, the operating cylinder stops in a position that cannot be determined and may then shift its position because the connectors are not pressurized. In many applications, however, it is desirable to reach a defined final position (operating piston either completely extended or retracted). If some cleaning on a stirrer driven by an oscillating valve needs to be performed, for example, it is first necessary to bring the operating cylinder into a position which makes the desired work possible at all. The system as described can still move, however, and will have to be fixed in position. This causes additional work here as well as with other applications.

It should also be mentioned that another disadvantage of the known arrangement is that it cannot be started up or turned off without an additional stop valve, and this causes further costs for the additional stop valve and the necessary installation.

The object of the present invention is to improve an oscillating valve of the above described kind in a way that the mentioned disadvantages of the known arrangements can be avoided, and particularly to find a simple means to having the oscillation occur in a controlled manner in the beginning and the end.

SUMMARY OF THE INVENTION

This object is reached with an oscillating valve of the above described kind by at least one of the NOT elements having a pressure connector that can be switched independently from the supply connector. Thus, the start-up can initially be compared directly to the sequence of motions during continuous operation. Uncontrolled start-up movements that also deviate from the set listed frequency are prevented from the beginning by a controlled turn-off. Turning off a running oscillation thus occurs by interrupting the pressure supply of the separately switched logic element which cannot initiate another cycle after the air drain pressure has decreased at the respective connector. The switch element of the reversing valve, especially of the valve piston, therefore remains on the side of the logic element which also causes the operating cylinder to reach the respectively defined final position and remain there, which causes the oscillation to cease.

The start-up of the operating cylinder then occurs from a defined final position. The separately switched logic element is connected to the pressure supply. In another embodiment of the invention, this independently switchable pressure connector of at least one of the NOT elements can be connected to the supply connector either via an internal manipulating valve or, on the other hand, to a connector for externally switchable pressure conveyance. Since no exhaust air pressure builds up at the respective operating cylinder drive connector, the corresponding logic element now supplies pressure to the operating piston of the reversing valve. The valve piston moves to the opposite side and thus initializes the oscillation. Since with a stopped system the other drive connector and the respective on that side of the operating cylinder are pressurized, the respective volume must be ventilated at the coordinated exhaust air throttle when the cycle begins. Another cycle is initiated only upon ventilation. Start-up thus shows the same characteristics as a running oscillation cycle and is therefore not dependent on the desired oscillation frequency or the cylinder volumes.

Based on the described configuration, the previously needed separate external stop valve is no longer required. As described, the oscillation comes to a halt by shutting off the separate pressure supply of one of the logical NOT elements which requires only either a pilot valve which can be integrated as an internal manipulating valve in the oscillating valve, or an external pilot valve. The size of that valve based on its function or the necessary flow rate is much less compared to the previously required external stop valve for the pressure supply.

Another advantage of the described arrangement based on the invention is also that the arrangement can trigger a single oscillating cycle with a slight pressure or electrical signal, the switch time of which is greater than the switch time of the oscillating valve. This makes a larger range of applications of such valves possible and, for example, can be used to move boxes from one conveyor belt to another. If a box approaches the end of the conveyor belt, it can, for example, trigger an electrical or pneumatic switch, the signal of which then extends the operating cylinder and move the respective object on. After retracting the operating cylinder, the system reaches its original position again and remains there until it receives another signal. Such applications were not possible with oscillating valves of the prior art.

In the following, the invention shall be described in greater detail schematically according to the drawings showing two different application examples.

DETAILED DESCRIPTION OF THE PREFERRED EMBODIMENTS

Figure 1:
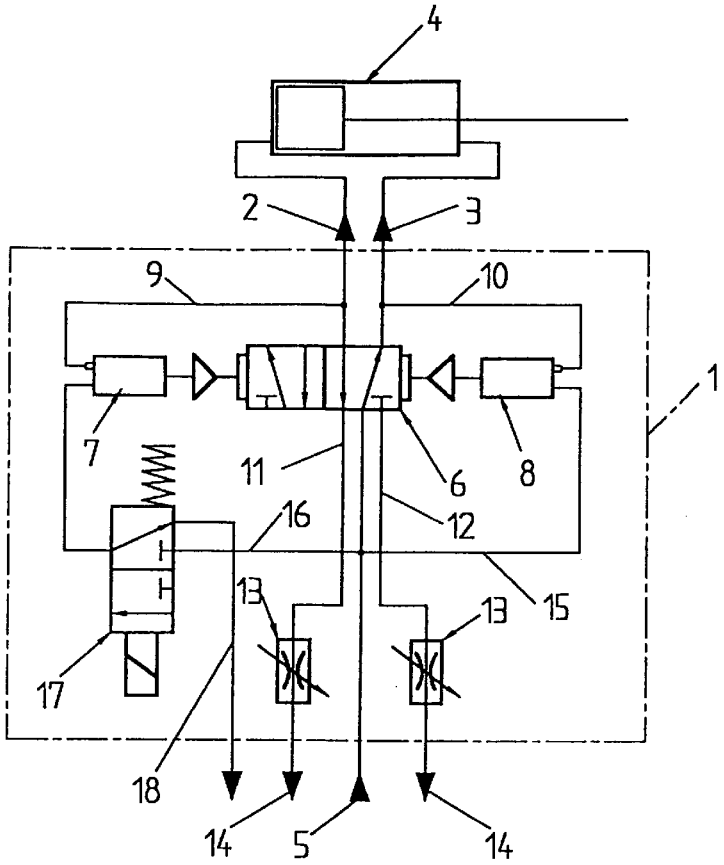
FIGS. 1 and 2 schematically depict two embodiments of oscillating valve according to the present invention.

The entire oscillating valve 1 in both embodiments is connected on one side via the operating cylinder drive connectors 2, 3 to a double acting pneumatic operating cylinder 4 and on the other side via a pressure supply connector 5 to a pressure source, not shown, such as a compressor or the like. Contained in the oscillating valve 1 is a reversing valve 6, inserted between the supply connector 5 and the drive connectors 2, 3, which has been shown here as a 5/2 directional valve. The valve piston or the operating element of this reversing valve 6 is reversed under pressure by an operating piston not seen in the drawing, where a logical NOT element 7,8 triggers the reversal on both sides; the negated connectors of the NOT elements are connected with the drive connectors 2,3 of the reversing valve 6 via conduits 9,10. The exhaust air of both sides of the operating cylinder is led out to exhaust air connectors 14 or into the open via conduits 11,12 and inserted adjustable throttles 13.

The control pressure supply of the logic elements 8 occurs in both embodiments directly via the supply connector 5 or a branched-off conduit 15. The control pressure supply of the other logic element 7 occurs in accordance with FIG. 1 via an internal manipulating valve 17 inserted into a conduit 16 branching off from supply connector 5, the exhaust air of which is discharged into the open via a conduit 18. In the case of the arrangement according to FIG. 2, the NOT element 7 is connected to a connector 20 of the externally switchable pressure supply via a conduit 19.

The control of the switch-over of the movement of the operating cylinder 4 occurs in both cases while oscillating by the scanning of the fluid pressure at the drive connectors 2,3 that are connected to the respective sides of the operating cylinder 4. Since the exhaust air of the cylinder is choked via the throttles 13, a stagnating pressure builds up at the respective drive connector 2,3. This is preserved until the piston of operating cylinder 4 stops. Since nearly ambient air is reached at the throttle 13 and therefore also at the negated connector of the respective logic element 7 or 8 via the conduit 9 or 10, the logic element 7 or 8 supplies the operating piston of the respective side of the reversing valve 5 with pressure which causes the reversing valve 6 to reverse and initiate another oscillating cycle.

Figure 2:
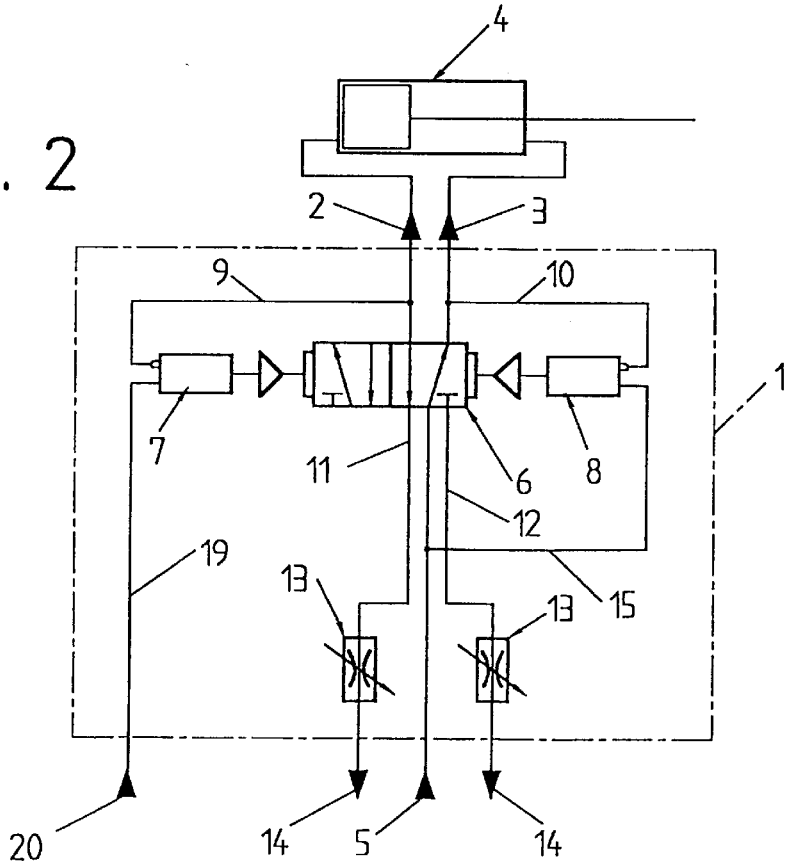

In both figures showing the two embodiments, the pressure supply of the logical NOT element 7 is interrupted in order to turn off the running oscillation—in the case of FIG. 1 by respectively selecting or reversing of the internal manipulating valve 17, and in the case of FIG. 2 by externally turning off the pressure supply supplied at the connector 20. During oscillation, the logic element 7 is therefore unable to initiate another cycle after the ventilation pressure decreased, which causes the reversing valve to remain on the side of this logic element 7 and the operating cylinder 4 also reaches a defined final position and stays there.

The start-up of the operating cylinder 4 now occurs from this defined reached final position. For this, the logic element 7 is again supplied with control pressure. In accordance with FIG. 1, this occurs by reversing the internal manipulating valve 17, and in accordance with FIG. 2, by supplying pressure to the connector 20. Since no ventilation pressure remains in the accompanying drive connector 2, the logic element 7 now supplies pressure to the accompanying operating piston of the reversing valve 6, which initiates the reversing valve 6 to assume the other switching position and initialize oscillation.

Since system pressure predominates at the connector 2 and at the respective side of the operating cylinder 4 when the system is turned off, the respective fluid volume must be ventilated at the accompanying throttle in the beginning of the cycle. Another cycle is initiated only after ventilation is complete. Thus, this start-up has practically the same characteristics as an oscillating cycle that is running already, and does not depend on the oscillation frequency or the cylinder volumes.

Since the oscillation comes to a halt when the control pressure supply of the logic element 7 is cut off, the external stop valve that was necessary at the prior art, in which the logic element 7 (as well as the logic element 8 in both drawings) was also connected with the supply connector 5, in front of the connector 5, is no longer needed.

For maintenance, alterations, or such activities where the entire system must be unpressurized, separate stop valves have to be added of course at appropriate places in the overall order (in the pressure supply), since here the other cylinder volume and the accompanying logic element are pressurized even when the operation cylinder 4 is in a defined final position.

Notwithstanding the described separate pressure supply that can be controlled only one-sidedly (at the logical NOT element 7), a respective optional control could, if needed, be provided for both logic elements 7,8 as well, where the corresponding operation cylinder 4 could either remain in one of its final positions or could be started from there (dependent on the switch of logic element 7 or 8). Also, besides the more detailed described arrangement of a pneumatic application, the solution based on the invention could also be used in hydraulic applications, where, instead of the mentioned "ventilations," a deliberate reversion of the respective medium back to the storage reservoir must occur.

We claim:

1. An oscillating valve (1) for a double acting operating cylinder (4), including a reversing valve (6) inserted between a pressure supply connector (5) and two operating cylinder drive connectors (2,3), which is driven via two NOT elements (7,8), each element being assigned to an operating position and connected with a drive connector (2,3) via a pressure conduit (15,16) and caused by pressure to switch between the two operating positions, wherein at least one of the NOT elements (7) includes a pressure connector that can be switched independently from the supply connector (5).

2. An oscillating valve according to claim 1, including an internal manipulating valve (17) connecting the independently switchable pressure connector with the supply connector (5).

3. An oscillating valve according to claim 1, including a connector (20) for connecting the independently switchable pressure connector with an externally switchable pressure supply.

* * * * *